US009571924B2

(12) United States Patent
Takumai

(10) Patent No.: US 9,571,924 B2
(45) Date of Patent: Feb. 14, 2017

(54) SPEAKER ARRAY APPARATUS AND METHOD FOR SETTING SPEAKER ARRAY APPARATUS

(71) Applicant: Yamaha Corporation, Hamamatsu-shi, Shizuoka-ken (JP)

(72) Inventor: Susumu Takumai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/972,212

(22) Filed: Dec. 17, 2015

(65) Prior Publication Data

US 2016/0182996 A1 Jun. 23, 2016

(30) Foreign Application Priority Data

Dec. 18, 2014 (JP) ..... 2014-255987

(51) Int. Cl.

| | |
|---|---|
| ***H04R 1/40*** | (2006.01) |
| ***H04S 7/00*** | (2006.01) |
| ***H04R 3/12*** | (2006.01) |
| ***H04R 5/04*** | (2006.01) |
| ***H04R 29/00*** | (2006.01) |

(52) U.S. Cl.

CPC ..... *H04R 1/403* (2013.01); *H04R 3/12* (2013.01); *H04R 5/04* (2013.01); *H04R 29/002* (2013.01); *H04S 7/301* (2013.01); *H04R 2201/401* (2013.01); *H04R 2203/12* (2013.01); *H04S 7/305* (2013.01)

(58) Field of Classification Search

None

See application file for complete search history.

(56) References Cited

U.S. PATENT DOCUMENTS

| | | | | |
|---|---|---|---|---|
| 8,041,060 | B2 * | 10/2011 | Takumai | H04R 3/12 381/303 |
| 8,274,611 | B2 * | 9/2012 | DeMartin | H04N 5/60 348/569 |
| 2008/0165979 | A1 | 7/2008 | Takumai | |
| 2009/0028358 | A1 * | 1/2009 | Suzuki | H04R 1/403 381/97 |
| 2009/0316938 | A1 * | 12/2009 | Matsumoto | H04R 3/12 381/300 |
| 2011/0013778 | A1 | 1/2011 | Takumai | |
| 2011/0135125 | A1 * | 6/2011 | Zhan | H04R 1/403 381/303 |

FOREIGN PATENT DOCUMENTS

| | | | |
|---|---|---|---|
| JP | 2006-13711 | A | 1/2006 |

* cited by examiner

*Primary Examiner* — Paul Huber

(74) *Attorney, Agent, or Firm* — Crowell & Moring LLP

(57) ABSTRACT

A speaker array apparatus includes a speaker array, a beam forming portion that is configured to cause the speaker array to output the sound beam, a beam control portion that is configured to sweep with the test sound beam in a predetermined angle range in a vertical direction with respect to a horizontal direction, a microphone, a distance obtaining portion that is configured to obtain a distance between the speaker array and the microphone, and a storage portion that is configured to store pickup sound data that is associated with the output angle. The beam control portion sets a minimum output angle of the angle range to be larger as the distance obtained by the distance obtaining portion is smaller.

16 Claims, 11 Drawing Sheets

Fig.5

| LISTENING DISTANCE | LARGE | SMALL |
|---|---|---|
| START ANGLE | SMALL | LARGE |
| SWEEP RANGE | WIDE | NARROW |

SPEAKER ARRAY APPARATUS AND METHOD FOR SETTING SPEAKER ARRAY APPARATUS

CROSS REFERENCE

This Nonprovisional application claims priority under 35 U.S.C. §119 (a) on Patent Application No. 2014-255987 filed in Japan on Dec. 18, 2014, the entire contents of which are hereby incorporated by reference.

BACKGROUND

1. Field

This disclosure relates to a speaker array apparatus capable of outputting sound beams from a speaker array having a plurality of speakers.

2. Description of the Related Art

Conventionally, a speaker array apparatus has distributed identical audio signals to a plurality of speakers that are arranged in a matrix form or in a line form and has applied a predetermined delay time to each of the distributed audio signals. Accordingly, a sound based on each of the audio signals simultaneously reaches a predetermined focal point in a listening space. As a result, the acoustic energy in the vicinity of the focal point is increased by in-phase addition. The speaker array apparatus, in this manner, produces a sound beam having a strong directivity in the focal direction.

As an invention related to such a speaker array apparatus, for example, an invention disclosed in Japanese Unexamined Patent Application Publication No. 2006-013711 is known. The speaker array apparatus disclosed in Japanese Unexamined Patent Application Publication No. 2006-013711 simultaneously outputs multichannel (for example, a center channel: Cch, a front left channel: Lch, a front right channel: Rch, a surround left channel: SLch, and a surround right channel: SRch) audio beams each having a different directivity.

In addition, the speaker array apparatus disclosed in Japanese Unexamined Patent Application Publication No. 2006-013711 reflects some of the multichannel audio beams on the wall surface of an installation space such as a room and then makes the audio beam for each channel reach a listening position from various directions. Thus, a listener at the listening position perceives an excellent surround effect.

A speaker array apparatus disclosed in Japanese Unexamined Patent Application Publication No. 2006-013711 (US 2008-0165979 A1), in order to reproduce a multichannel surround sound, requires the output direction of an audio beam of each of channels to be set correctly. Therefore, the speaker array apparatus disclosed in Japanese Unexamined Patent Application Publication No. 2006-013711, while sweeping with a test sound beam, picks up a direct sound and a reflected sound of the test audio beam by a microphone that is arranged at the listening position. Then, the speaker array apparatus disclosed in Japanese Unexamined Patent Application Publication No. 2006-013711 obtains a relationship between an output angle of the test audio beam and a level of the picked-up audio signal. Thereafter, the speaker array apparatus specifies the output angle in which the level of the picked-up audio signal is at peak and determines the output angle of the audio beam of each channel based on the specified output angle.

In a multichannel surround sound, a mode adding a height channel has been proposed. The mode adds, to a horizontally directed sound field, a sound source of a height channel that reaches from the upper front side toward a listening position.

Such a mode of adding the height channel enables a sound field according to a height or depth direction and thus can provide a higher level of the sound field.

The following considers a case in which the speaker array apparatus disclosed in Japanese Unexamined Patent Application Publication No. 2006-013711 outputs an audio beam of a height channel. Even in such a case, the output direction of the audio beam of the height channel is required to be set correctly. In view of the foregoing, the speaker array apparatus disclosed in Japanese Unexamined Patent Application Publication No. 2006-013711 may pick up a sound by a microphone that is arranged at a listening position while sweeping with a test audio beam in the vertical direction. Then, the speaker array apparatus disclosed in Japanese Unexamined Patent Application Publication No. 2006-013711 determines the output direction of the audio beam of the height channel based on the relationship between the output angle of the test audio beam and the level of the picked-up audio signal.

In a case in which the speaker array apparatus disclosed in Japanese Unexamined Patent Application Publication No. 2006-013711 sweeps with the test audio beam in the vertical direction, the microphone picks up a direct sound and a reflected sound of the test audio beam. As described above, the audio beam of the height channel is required to reach from the upper front side to the listening position. Therefore, the output direction of the audio beam of the height channel may preferably be set to an output angle of a test audio beam of which a reflected sound, reflected at a ceiling surface, has a peak of a signal level, among reflected sounds that the microphone has picked up. In another case in which the output direction of the audio beam of the height channel is set to an output angle corresponding to the direct sound of the test audio beam, a desired surround sound effect cannot be provided.

SUMMARY

A speaker array apparatus according to various preferred embodiments of the present invention includes a speaker array including a plurality of speakers arranged in a matrix form or in a line form, a beam forming portion configured to distribute a sound signal to each of the speakers and to control an output timing of a sound that is output from each of the speakers so as to cause the speaker array to output a sound beam, a beam control portion configured to output to the beam forming portion a test signal and an output angle of a test sound beam based on the test signal and to output angle of a test sound beam based on the test signal and turn (sweep with) the test sound beam by changing the output angle, in a predetermined angle range in a vertical direction with respect to a horizontal direction, a microphone arranged at a listening position, a distance obtaining portion configured to obtain a distance between the speaker array and the microphone, and a storage portion configured to store pickup sound data generated by a sound picked up by the microphone, the pickup sound data being associated with the output angle.

The beam control portion sets the output angle corresponding to the peak of the signal level of the pickup sound data stored in the storage portion as the output angle of the sound beam of a height channel.

In such a case, the output angle of the sound beam of the height channel is required to be closer to the vertical direction as the speaker array and the listening position are closer. Accordingly, the beam control portion sets a minimum output angle of the angle range to be larger as the distance obtained by the distance obtaining portion is smaller. Thus, the test sound beam is output in a range of angle away from the angle of the direct sound of which the angle is close to the horizontal direction.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 5 is a view illustrating a relationship between a listening distance according to the first preferred embodiment and a sweep condition of a height sound beam.

DETAILED DESCRIPTION OF THE PREFERRED EMBODIMENTS

Hereinafter, a speaker array apparatus 1 according to a first preferred embodiment of the present invention will be described in detail with reference to the attached drawings.

First Preferred Embodiment

Figure 1:
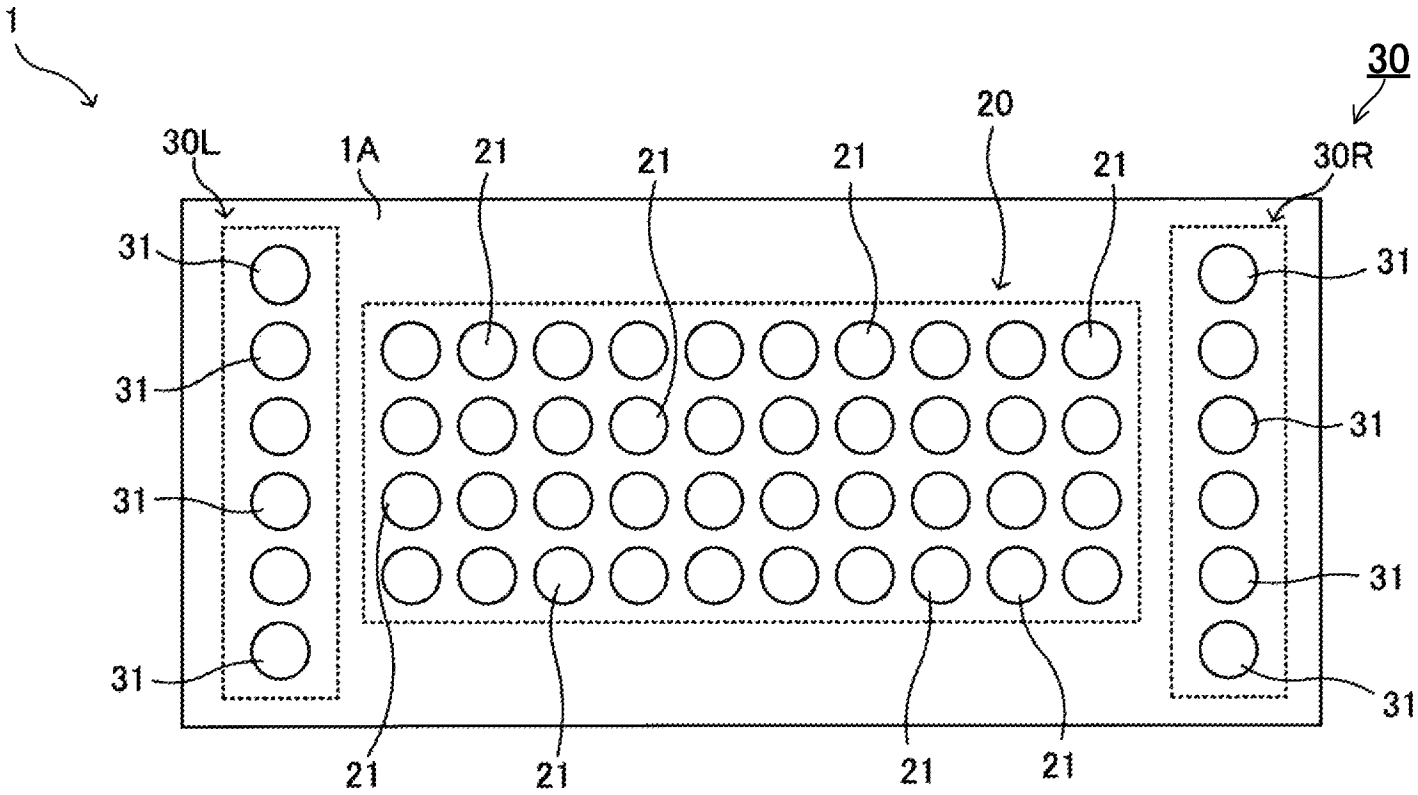
FIG. 1 is a front view of a speaker array apparatus according to a first preferred embodiment.

As shown in FIG. 1, the speaker array apparatus 1 includes a speaker array 20 and a height speaker array 30 in the front face (a face to a listener) of an apparatus body 1A. The speaker array 20 is configured to produce a sound field in a horizontal direction. The height speaker array 30 is configured to produce a sound field in a height direction (vertical direction). The speaker array apparatus 1 controls the output direction of each of multichannel sound beams and can give a listener a surround sound sensation as if actual speakers are arranged around the listener.

The speaker array 20 includes a plurality of speakers 21 that are arranged in a matrix form, in the central part of the front face of the apparatus body 1A. The speaker array 20 outputs each of the sound beams of a center channel (Cch), a front left channel (Lch), a front right channel (Rch), a surround left channel (SLch), and a surround right channel (SRch) (see FIG. 2A). However, the plurality of speakers 21 may be arranged in a line form along the horizontal direction in a top surface of the apparatus body 1A.

Figure 2A:
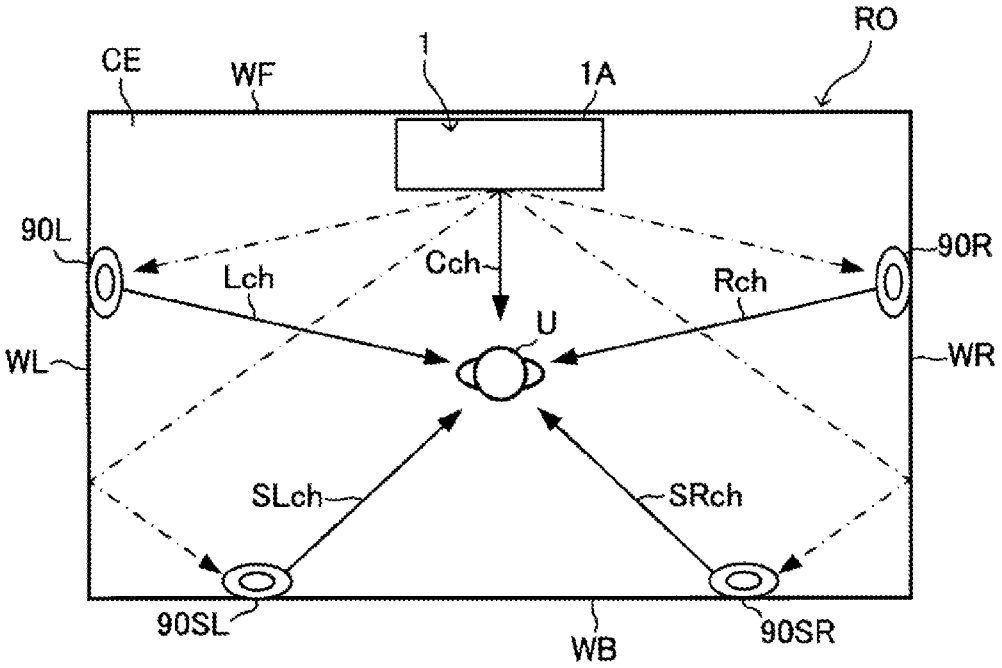
FIG. 2A and FIG. 2B are views each illustrating how the speaker array apparatus outputs multichannel sound beams.

The speaker array apparatus 1 individually controls the delay time of each sound beam signal that is output to the corresponding speaker 21 of the speaker array 20 and outputs a sound beam from the speaker array 20. The speaker array apparatus 1 outputs the sound beam for each channel. The speaker array apparatus 1, as shown in FIG. 2A, for example, reflects an Lch sound beam by a left wall WL and defines a virtual speaker 90L.

The height speaker array 30L, in the left end portion of the front face of the apparatus body 1A, includes a plurality of height speakers 31 that are each arranged along the vertical direction. The height speaker array 30L outputs a sound beam of a height left channel (HLch). The height speaker array 30R, in the right end portion of the front face of the apparatus body 1A, includes a plurality of height speakers 31 that are each arranged along the vertical direction. The height speaker array 30R outputs the sound beam of a height right channel (HRch). However, the plurality of height speakers 31 may be arranged in a matrix form.

It is to be noted that the height speaker array 30L and the height speaker array 30R are collectively referred to as the height speaker array 30.

Figure 2B:
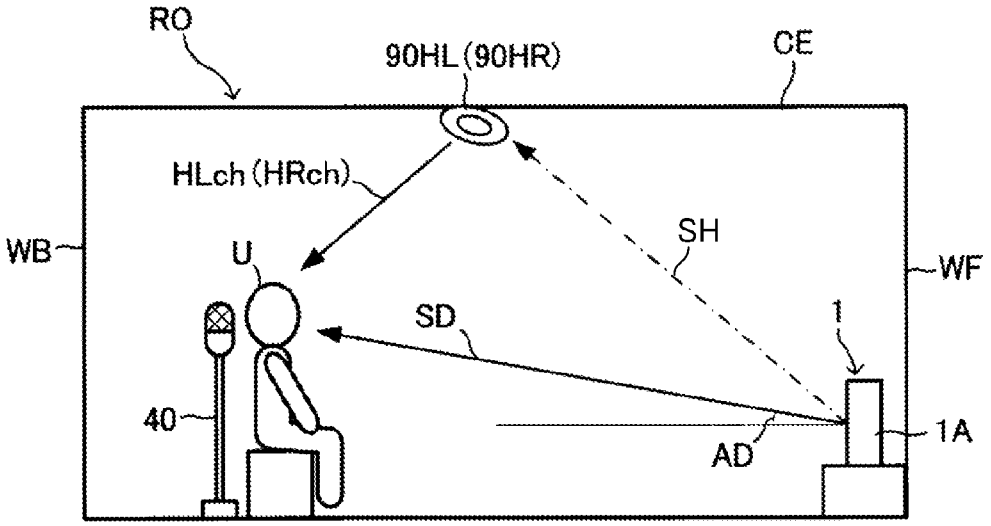

The speaker array apparatus 1 individually controls the delay time of each sound beam signal that is output to the corresponding height speaker 31 of the height speaker array 30 and outputs a sound beam from the height speaker array 30. The speaker array apparatus 1 outputs the sound beam for each height channel. The speaker array apparatus 1, as shown in FIG. 2B, reflects an HLch sound beam and an HRch sound beam by a ceiling CE and defines a virtual speaker 90HL and a virtual speaker 90HR. Accordingly, the speaker array apparatus 1 adds a sound field in a height direction and a depth direction to the sound field expressed in a multichannel horizontal direction.

If the timings of the sounds to be output from each of the speakers 21 and each of the height speakers 31 are adjusted, it is possible to control, with respect to the vertical direction, an output angle of sound beams to be output from the speaker array 20 and an output angle of sound beams SH to be output from the speaker array 30.

Control System of the Speaker Array Apparatus 1

Figure 3:
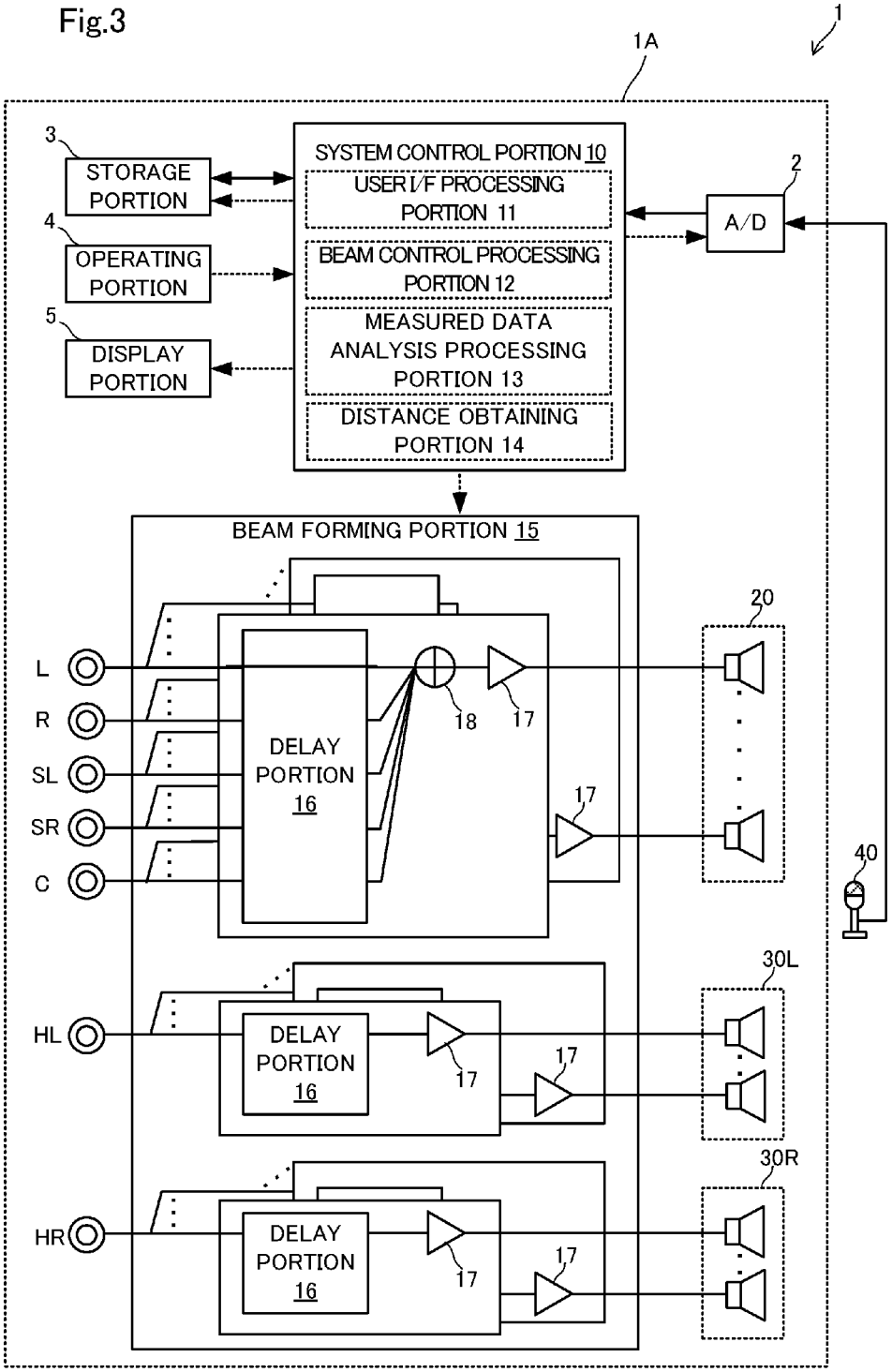
FIG. 3 is a functional block diagram showing a part of a configuration of the speaker array apparatus.

Subsequently, a control system configuration of the speaker array apparatus 1 will be described in detail with reference to FIG. 3. As shown in FIG. 3, the speaker array apparatus 1 includes an A/D converter 2, a storage portion 3, an operating portion 4, a display portion 5, a system control portion 10, a beam forming portion 15, and a microphone 40. The speaker array apparatus 1 also includes, as a multichannel external input terminal, an Lch terminal, an Rch terminal, an SLch terminal, an SRch terminal, a Cch terminal, an HLch terminal, and an HRch terminal.

The microphone 40 is a non-directional microphone and is connected to the A/D converter 2.

The A/D converter 2 converts (samples) an analog sound signal generated based on the sound that has been picked up by the microphone 40, into a digital sound signal, and outputs the digital sound signal to the system control portion 10.

Figure 4:
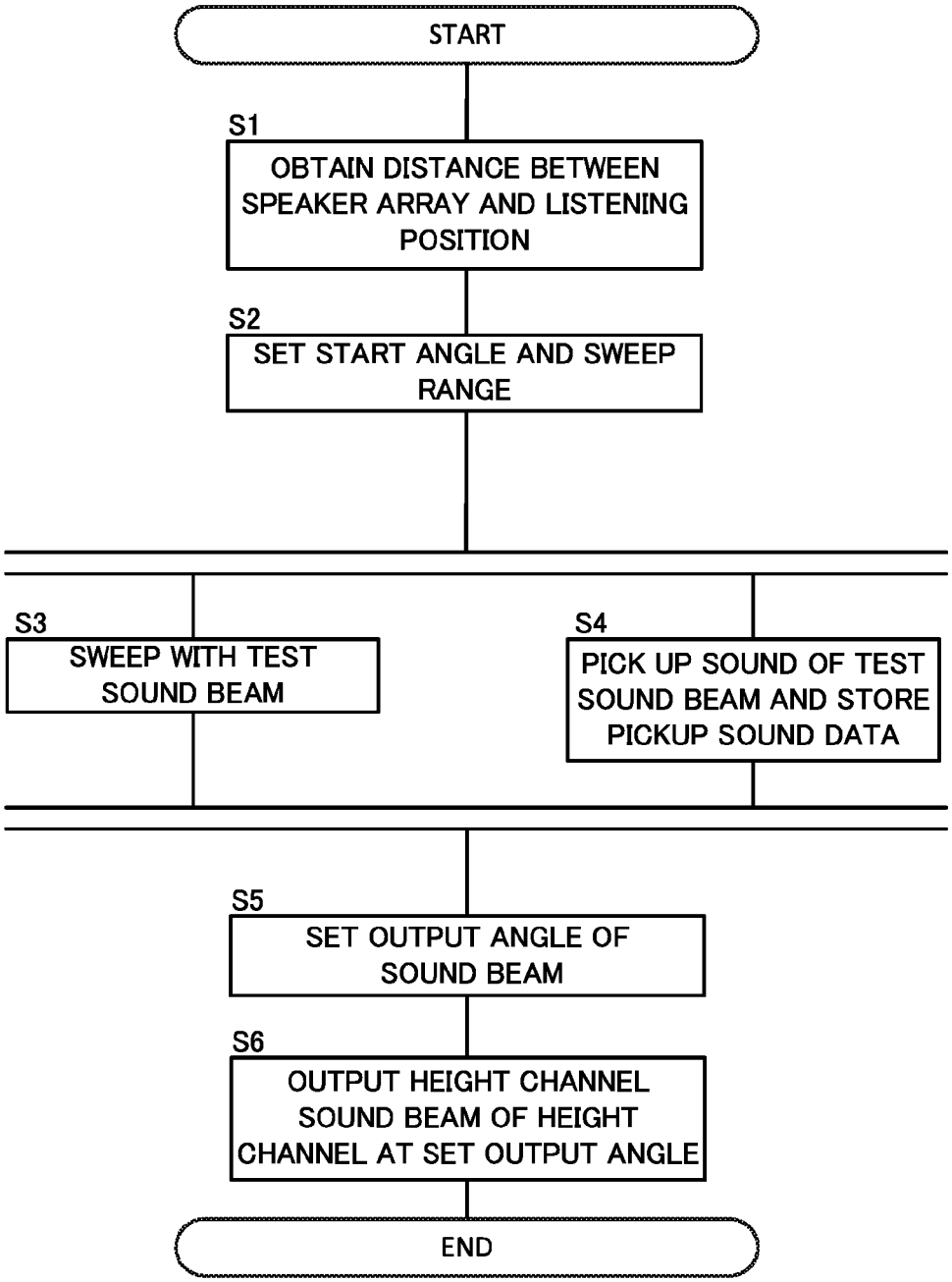
FIG. 4 is a flowchart showing a method of setting the speaker array apparatus according to the first preferred embodiment.

The storage portion 3 stores pickup sound data including the digital sound signal that has been input to the system control portion 10. Specifically, the storage portion 3 stores the level (microphone input signal level) of the digital sound signal that has been input to the system control portion 10 and the output angle of a test sound beam that are in association with each other (FIG. 4 and FIG. 5). The output angle of the test sound beam will be described below. The storage portion 3 may be realized by a non-volatile memory such as a magnetic disk and a flash memory or a volatile memory such as a D-RAM.

The operating portion 4 receives various setting inputs from a listener U and outputs a signal in accordance with the setting inputs to the system control portion 10.

The display portion 5, based on a control signal that has been output from the system control portion 10, displays contents in accordance with the control signal.

The system control portion 10 has a user I/F processing portion 11, a beam control processing portion 12, a measured data analysis processing portion 13, and a distance obtaining portion 14. Such processing portions, while being realized by a Central Processing Unit, for example, may also be realized by the execution of a program.

The user I/F processing portion 11 outputs the control signal to other processing portions of the speaker array apparatus 1 in accordance with an operation received by the operating portion 4. The user I/F processing portion 11 also outputs the control signal in accordance with the condition of the speaker array apparatus 1 to the display portion 5.

The beam control processing portion 12, during execution of a setting mode in which an output angle of the sound beam of each channel is set, outputs a test signal and an angle setting signal to the beam forming portion 15, the angle setting signal indicating the output angle of the test sound beam based on the test signal. The beam control processing portion 12 changes the output angle indicated by the angle setting signal so as to sweep with (turn) the sound beam that is output from the speaker array 20.

The measured data analysis processing portion 13 causes the storage portion 3 to store the pickup sound data that has been generated by the sound picked up by the microphone 40 during the execution of the setting mode.

In addition, the measured data analysis processing portion 13, when the collection of the pickup sound data is completed, detects a peak of the signal level in the pickup sound data stored in the storage portion 3. Then, the measured data analysis processing portion 13 obtains the output angle of the sound beam based on the peak. The measured data analysis processing portion 13 outputs the obtained output angle to the beam control processing portion 12. The measured data analysis processing portion 13, with respect to each of channels configuring a multichannel environment, outputs the output angle of the sound beam for each channel to the beam control processing portion 12.

The distance obtaining portion 14 obtains a distance between the height speaker array 30 and the listening position. In some embodiments, the distance obtaining portion 14 obtains the distance by using a test sound beam that is output from the speaker array 20.

The beam forming portion 15 has blocks each including a delay portion 16 and a power amplifier 17 for each of the speakers 21 of the speaker array 20. The beam forming portion 15 has blocks each including a delay portion 16 and a power amplifier 17 for each of the height speakers 31 of the height speaker array 30L and the height speaker array 30R. It should be noted that the beam forming portion 15, while being realized by a Digital Signal Processor, may also be realized by the execution of a program.

The block for each of the speakers 21 of the speaker array 20 includes the delay portion 16 configured to perform delay processing upon the sound signals according to each of the Lch, Rch, SLch, SRch, and Cch channels individually, an adder 18 configured to add sound signals that have been output from the delay portion 16, and the power amplifier 17 configured to amplify the signals that have been output from the adder 18. For the output of each of the blocks, the speakers 21 are connected to the blocks, respectively.

The beam forming portion 15, with such a configuration, after distributing an Lch sound signal to each of the blocks, delays each of the distributed sound signals by a predetermined delay time. The each delay time is set based on an Lch angle setting signal that has been output from the beam control processing portion 12. Accordingly, each of the sound beam signals that have been delayed individually is output to each of the speakers 21. Then, the Lch sound that has been output from each of the speakers 21 forms a sound beam having directivity at the output angle indicated by the angle setting signal. The beam forming portion 15 performs the same processing for the Rch, Cch, SLch, and SRch channels. The sound beams of the channels are also output from the speaker array 20 at a predetermined output angle.

The block for each of the height speakers 31 of the height speaker array 30L includes a delay portion 16 configured to perform delay processing upon the sound signals according to HLch, and the power amplifier 17 configured to amplify the signals that have been output from the delay portion 16. The block for each of the height speakers 31 of the height speaker array 30R includes a delay portion 16 configured to perform delay processing upon the sound signals according to HRch, and a power amplifier 17 configured to amplify the signals that have been output from the delay portion 16. For the output of each of the blocks according to the height speaker array 30R and the height speaker array 30L, the height speakers 31 are connected to the blocks, respectively.

The beam forming portion 15, with such a configuration, after distributing an HLch sound signal to each block, delays each of the distributed sound signals by a predetermined delay time. The each delay time is set based on an HLch angle setting signal that has been output from the beam control processing portion 12. Accordingly, each of the sound beam signals that have been delayed individually is output to each of the height speakers 31. Then, the HLch sound that has been output from each of the height speakers 31 forms a sound beam having directivity at the output angle shown in the angle setting signal. The beam forming portion 15 also performs the same processing for the HRch channel. The sound beam of the HRch channel is also output from the height speaker array 30R at a predetermined output angle.

Setting of the Output Angle of Each Sound Beam from the Speaker Array 20

Subsequently, the setting of the output angle of the sound beam of each of the Lch, Rch, SLch, SRch, and Cch channels by the speaker array 20 will be described in detail with reference to the drawings.

It should be noted that, in order to make the preferred embodiments of the present invention understood easily, the following description will be made of a case in which a room RO where the speaker array apparatus 1 is installed has a rectangular parallelepiped shape as an ideal shape and the apparatus body 1A of the speaker array apparatus 1 is installed near the center of the front wall WF of the room RO.

In such a case, the apparatus body 1A of the speaker array apparatus 1 is installed so as to face a center portion of the front wall WF as a desired position of the listener U so that the front face of the speaker array 20 is arranged in parallel to the front wall WF and also opposite to a rear wall WB. Before the setting of the output angle of the sound beam is started, the microphone 40 is connected to the A/D converter 2 and installed at a listening position (audience position) of the listener U. In this event, the height of the microphone 40 may preferably be matched to the height of the ears of the listener U.

When the installation of the apparatus body 1A and the microphone 40 of the speaker array apparatus 1 is completed and a setting mode related to the speaker array 20 is started, the speaker array apparatus 1, by outputting test sound beams from the speaker array 20 and picking up a sound by the microphone 40, measures a direct sound output angle AD of a direct sound SD from the speaker array 20 to the microphone 40 and a horizontal distance (hereinafter will be referred to as a listening distance) between the speaker array 20 and the microphone 40.

Specifically, the system control portion 10 outputs a test signal to the beam forming portion 15 and outputs an angle setting signal while changing the angle setting signal so that the test sound beam sweeps (turns). The output angle shown in the angle setting signal is set in a predetermined range (from the minus 45-degree direction to the plus 45-degree direction, for example) in the vertical direction when the horizontal direction is set to zero degrees. Then, the microphone 40 picks up the sound of each of the test sound beams that have been output from the speaker array 20. The A/D converter 2 converts a picked-up analog sound signal into a digital sound signal. The system control portion 10 causes the storage portion 3 to store pickup sound data including the digital sound signal in association with the output angle and analyzes the data and the output angle so as to specify the direct sound output angle AD of the direct sound SD (see FIG. 2B). The direct sound output angle AD is temporarily stored in the storage portion 3 and is used for the setting of the output angle of the sound beam of the height channel.

In addition, the distance obtaining portion 14, by calculating a time difference between an output timing of a test sound beam and a pickup sound timing of the direct sound of the test sound beam by the microphone 40, obtains a horizontal distance (hereinafter will be referred to as a listening distance) approximately between the speaker array 20 and the microphone 40. This listening distance is temporarily stored in the storage portion 3 and is used for the setting of the output angle of the sound beam of the height channel.

It is to be noted that the test signal that is output from the system control portion 10 may preferably be the signal of a sound having no periodicity, for example, around 4 kHz, and the signal of a sound such as a white noise having no periodicity. The band of the sound, since being higher in directivity than a low frequency region, is suitable for setting the output angle of the sound beam that is determined by the shape of the speaker array apparatus 1 and the arrangement of each of the speakers 21 of the speaker array 20.

Subsequently, the system control portion 10 sweeps with (turns) the test sound beam in the horizontal direction. Specifically, the system control portion 10 outputs a test signal to the beam forming portion 15 and outputs an angle setting signal while changing the angle setting signal. The output angle shown in the angle setting signal, in a case in which the speaker array 20 is viewed from the upper side of the room RO, is set between one direction (zero-degree direction) parallel with the front face of the speaker array 20 and the other direction (180-degree direction) parallel to the front face of the speaker array 20.

Then, the microphone 40 picks up a reflected sound reflected by the wall of the room RO and a direct sound that has been output from the speaker array 20. The A/D converter 2 converts a picked-up analog sound signal into a digital sound signal. The system control portion 10 causes the storage portion 3 to store pickup sound data including the digital sound signal in association with the output angle and analyzes the data and the output angle so as to set the output angle corresponding to a peak value of the gain level having a predetermined value or higher to an output angle on the horizontal plane of the sound beams of the Lch, Rch, SLch, SRch, and Cch.

In this way, when the output angle on the horizontal plane is set and an audio sound or the like is input from the outside, the speaker array apparatus 1, as shown in FIG. 2A, outputs, to the listener U, the Cch sound beam as a direct sound, the Lch sound beam as a reflected sound reflected once by the left wall WL, and the Rch sound beam as a reflected sound reflected once by the right wall WR. In addition, the speaker array apparatus 1 outputs the SLch sound beam as a reflected sound reflected twice by the left wall WL and the rear wall WB and also outputs the SRch sound beam as a reflected sound reflected twice by the right wall WR and the rear wall WB.

Thus, the listener U can enjoy listening an ideal surround-sound because the listener U can listen, at the listening position, to the Cch sound that has been output from the speaker array apparatus 1 positioned in the front of the listening position, the Lch sound from the virtual speaker 90L positioned at the left front of the listening position, the SLch sound from the virtual speaker 90SL positioned at the left rear of the listening position, the SRch sound from the virtual speaker 90SR positioned at the right rear of the listening position, and the Rch sound from the virtual speaker 90R positioned at the right front of the listening position.

Setting of the Output Angle of Each Height Sound Beam SH from a Height Speaker Array 30

Subsequently, the setting of the output angle of the height sound beam SH of each of the HLch and HRch channels by the height speaker array 30 will be described in detail with reference to the drawings.

As described above, the sound beams of the height channels (HLch and HRch) reach to the listening position from the virtual speaker 90HL and the virtual speaker 90HR that are positioned in the upper front side to the listening position and produce a sound field according to the height direction (vertical direction). Therefore, the height sound beam SH is required to be output so as to reach the listening position (the microphone 40) after being reflected at least once by the ceiling CE of the room RO, and the output angle AH of the height sound beam SH is also set to meet the requirements.

In view of the above, as shown in FIG. 4, the system control portion 10 first obtains a listening distance D between the height speaker array 30 and the listening position (S1). This listening distance D is approximated with the listening distance between the speaker array 20 and the listening position. Accordingly, the listening distance D is obtained by reading the listening distance between the speaker array 20 and the listening position from the storage portion 3.

Subsequently, the system control portion 10 sets a sweep range RS of a test signal beam (S2). This sweep range RS is from a start angle AS with respect to the horizontal plane to an end angle AE. The start angle AS is the minimum angle of the sweep range RS, and the end angle AE is the maximum angle of the sweep range RS. Then, the system control portion 10, while outputting a test signal, outputs an angle setting signal while changing the angle setting signal so as to sweep with (turn) the test sound beam (S3). Furthermore, the system control portion 10, while performing the processing of step S3, picks up the sound of test sound beam that has been output from the height speaker array 30 by the microphone 40 and causes the storage portion 3 to store the pickup sound data together with the output angle indicated by the angle setting signal (S4). Then, the system control portion 10 obtains the output angle AH of the height sound beam SH by analyzing and specifying the angle corresponding to the peak level of the pickup sound data (S5). The setting of the output angle AH is thus completed. Subsequently, the speaker array apparatus 1 outputs the sound beam SH of the height channel with the set output angle AH (S6).

In step S2, the system control portion 10, based on the listening distance D between the height speaker array 30 and the microphone 40 (listening position), sets the start angle AS and the sweep range RS.

As shown in FIG. 5, the system control portion 10 sets the start angle AS to be smaller as the listening distance D is larger and sets the start angle AS to be larger as the listening distance D is smaller. In the first preferred embodiment, the start angle AS, in a case in which the horizontal direction is set to zero degrees, is set to a value obtained by dividing a predetermined integer (for example 100) by the listening distance D (m). However, the method for setting this output angle AS is only an example and can be changed accordingly. Alternatively, the system control portion 10 sets the sweep range RS to be larger as the listening distance D is larger and sets the sweep range RS to be smaller as the listening distance D is smaller.

Setting of the Output Angle AH of the Height Sound Beam SH in a Case in which the Listening Distance D is Large The setting of the output angle AH in the case in which the listening distance D is large will be described in detail with reference to FIG. 6A and FIG. 6B. As described above, in the case in which the listening distance D is large, the system control portion 10 sets the start angle AS to be small and sets the sweep range RS to be large. It should be noted that FIG. 6B shows a relationship between the level of a sound signal that has been picked up by the microphone 40 and the output angle of the test sound beam of the height channel. The solid line as shown in FIG. 6B shows the signal level of the sound that has actually been picked up by the microphone 40, and the dashed line shows the signal level of the sound to be picked up under the assumption that the test sound beam has been output in the angle range from the output angle of zero degrees to the output angle AS.

Figure 6A:
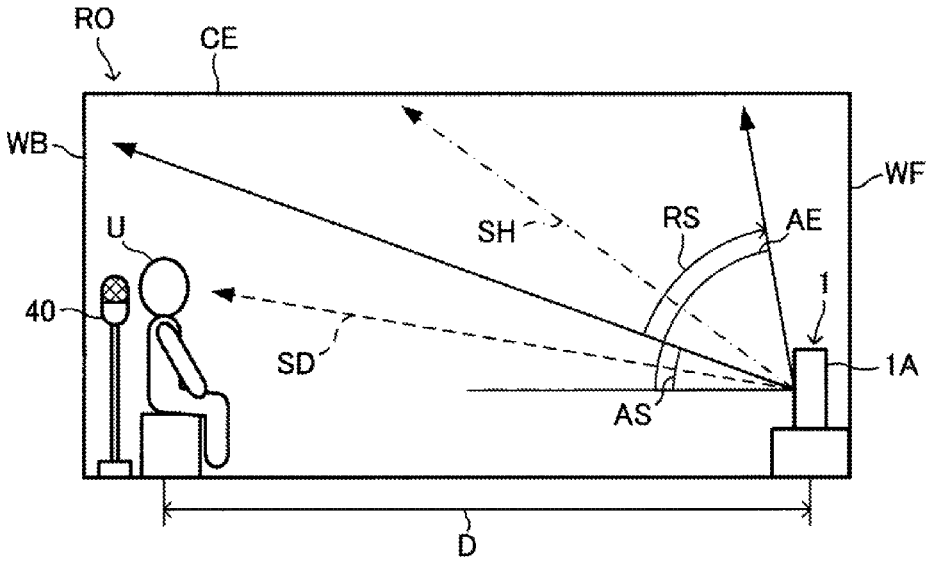
FIG. 6A is a view showing a setting of an output angle of the height sound beam in a case in which the listening distance is large and FIG. 6B is a view showing a relationship between a level of a sound signal that has been picked up in the case in which the listening distance is large and the output angle of a test sound beam.
Figure 6B:
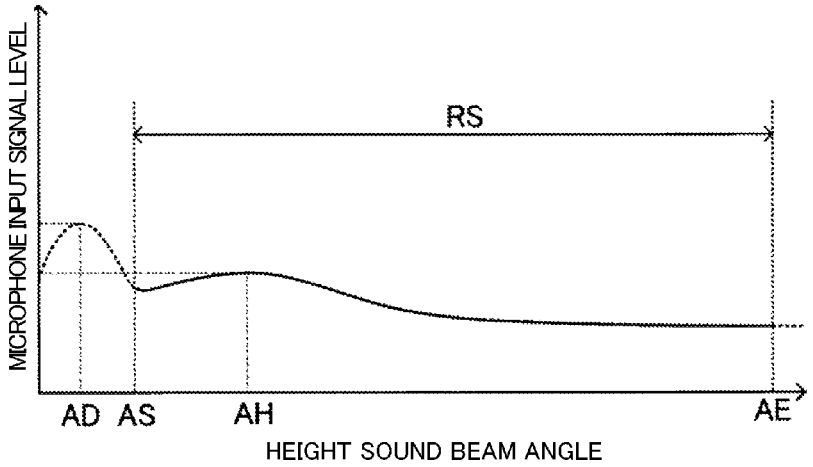

As shown in FIG. 6A, the start angle AS is set to be smaller as the listening distance D is larger and is constantly set to be larger than the direct sound output angle AD (step S2). It should be noted that the direct sound output angle AD is read from the storage portion 3. Then, the test sound beam turns (sweeps) from the start angle AS to the end angle AE. Accordingly, the sweep range RS does not include the direct sound output angle AD. This enables the microphone 40 to pick up only the reflected sound of the test sound beam that has been reflected by at least the ceiling CE (see FIG. 6A and FIG. 6B). In other words, the speaker array apparatus 1 does not erroneously set the direct sound output angle AD as the output angle AH of the height sound beam SH and can set the output angle of the sound beam that heads toward the listening position after being reflected by the ceiling CE.

In addition, as the listening distance D is larger, the sound beams from the height speaker array 30 are less likely to overlap the listening position (the listener U and the microphone 40). Moreover, the output angle AH, in principle, becomes smaller as the listening distance D becomes larger. Accordingly, the speaker array apparatus 1, by setting the start angle AS to be small and the sweep range RS to be large, can detect the output angles AH without omission. Thus, in such a case, the speaker array apparatus 1 can reliably set the output angle AH of the height sound beam SH.

Setting of the Output Angle of the Height Sound Beam SH in a Case in which the Listening Distance D is Small The setting of the output angle of the height sound beam SH in the case in which the listening distance D is small will be described in detail with reference to FIG. 7A and FIG. 7B. As described above, in the case in which the listening distance D is small, the system control portion 10 sets the start angle AS to be large and sets the sweep range RS to be small. It is to be noted that FIG. 7B shows a relationship between the signal level of a sound that has been picked up by the microphone 40 and the output angle of the test sound beam of the height channel. The solid line as shown in FIG. 7B shows the signal level of the sound that has actually been picked up by the microphone 40, and the dashed line shows the signal level of the sound under the assumption that the test sound beam has been output in the angle range from the output angle of zero degrees to the output angle AS.

Figure 7A:
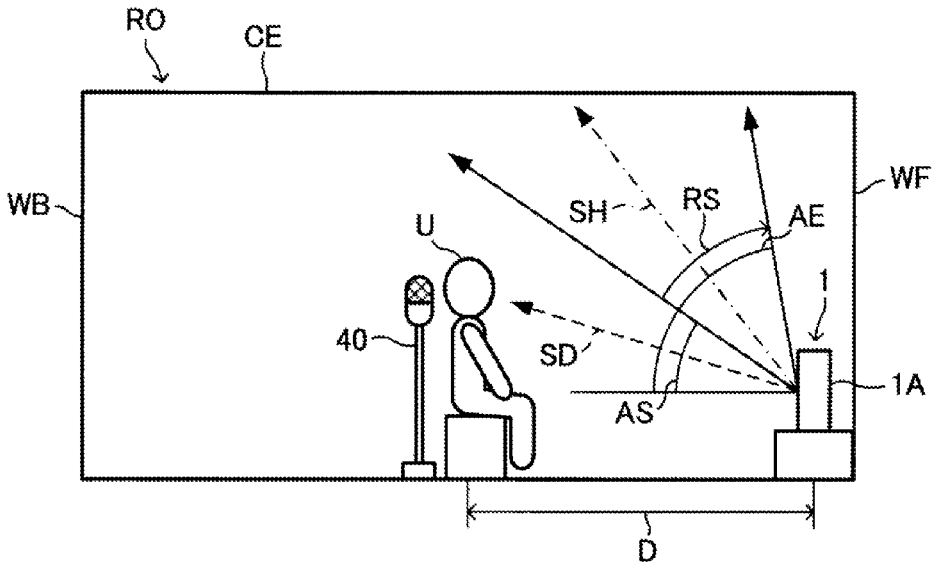
FIG. 7A is a view showing the setting of the output angle of the height sound beam in a case in which the listening distance is small and FIG. 7B is a view showing the relationship between the level of the sound signal that has been picked up in the case in which the listening distance is small and the output angle of a height test sound beam.
Figure 7B:
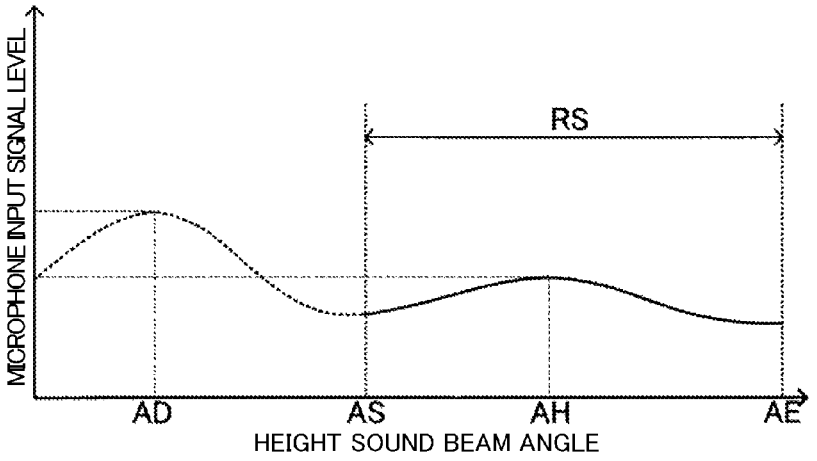

As shown in FIG. 7A, the start angle AS is set to be larger as the listening distance D is smaller and is constantly set to be larger than the direct sound output angle AD. Then, the test sound beam turns (sweeps) from a height sweep start angle AS to the end angle AE. Accordingly, the sweep range RS does not include the direct sound output angle AD. This enables the microphone 40 to pick up only the reflected sound of the test sound beam that has been reflected by at least the ceiling CE (see FIG. 7A and FIG. 7B). In other words, the speaker array apparatus 1 does not erroneously set the direct sound output angle AD as the output angle AH of the height sound beam SH and can set the output angle of the sound beam that heads toward the listening position after being reflected by the ceiling CE.

In addition, as the listening distance D is smaller, the sound beams from the height speaker array 30 are more likely to overlap the listening position (the listener U and the microphone 40). Moreover, the output angle AH, in principle, becomes larger as the listening distance D becomes smaller. In view of the foregoing, the speaker array apparatus 1, by setting the output angle AH to be large and the sweep range RS to be small, can perform the sweep of the test sound beam from the output angle having no effect on the overlapping at the listening position and can also efficiently set the output angle AH of the height sound beam SH.

It should be noted that, while illustration is omitted, even in any of FIG. 6A, FIG. 6B, FIG. 7A, and FIG. 7B, in a case in which there are a plurality of peaks of the signal level in the pickup sound data in the sweep range RS, the system control portion 10, among the plurality of peaks, sets an output angle corresponding to a peak of the signal level becomes maximum as the output angle AH. Thus, the speaker array apparatus 1 can set the most suitable output angle as the output angle AH of the height sound beam SH and can achieve a more effective sound field.

In addition, when the output angle of the sound beam is set, the system control portion 10 may control each portion of the speaker array apparatus 1 to execute the sweep of the test sound beam a plurality of times and execute a process such as an integrating/averaging process upon the digital sound signal of the pickup sound data. This enables the system control portion 10 to increase the measurement accuracy.

Moreover, in the preferred embodiment described above, the speaker array apparatus 1 obtains the direct sound output angle AD by sweeping with (turning) the test sound beams that are output from the speaker array 20.

However, the speaker array apparatus 1 may obtain the direct sound output angle AD by sweeping with (turning) the test sound beams that are output from the height speaker array 30. In this regard, it is not essential to the preferred embodiment to obtain the direct sound output angle AD. For example, a value obtained by dividing 100 by the listening distance D may be used without obtaining the direct sound output angle AD as the start angle AS as it is.

Second Preferred Embodiment

Subsequently, a preferred embodiment (a second preferred embodiment) different from the above described first preferred embodiment will be described in detail with reference to FIG. 8 to FIG. 10. It is to be noted that a speaker array apparatus 1 according to the second preferred embodiment has a basic configuration that is substantially the same as the basic configuration of the speaker array apparatus 1 according to the first preferred embodiment and executes a different method of setting the output angle AH of the height sound beam SH. The description of the configuration similar to the configuration of the first preferred embodiment is omitted and only the differences in configuration will be described in detail.

Setting of the Output Angle of the Height Sound Beam SH According to the Second Preferred Embodiment The setting of the output angle of the height sound beam SH of each of the HLch and HRch channels will be described in detail with reference to FIG. 8 to FIG. 10.

Figure 8:
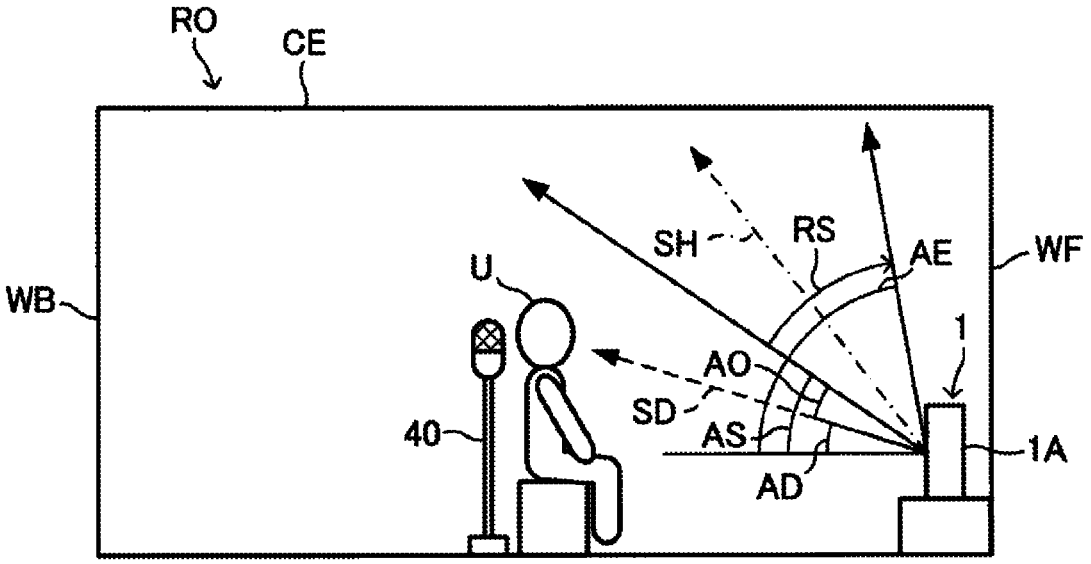
FIG. 8 is a view illustrating a setting of an output angle of a height sound beam according to a second preferred embodiment.
Figure 9:
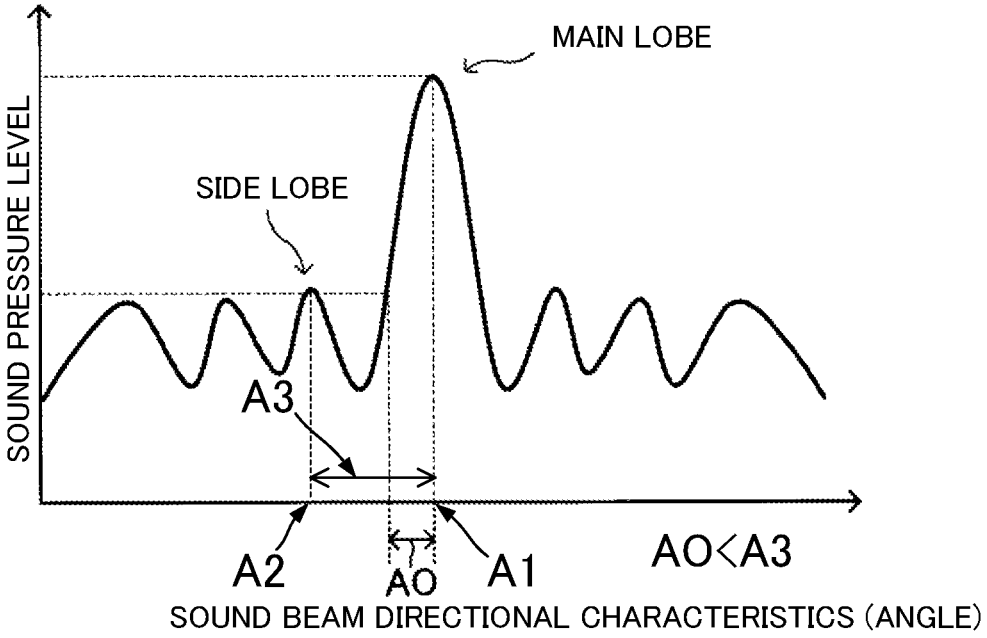
FIG. 9 is a view showing a directivity of a sound beam.
Figure 10:
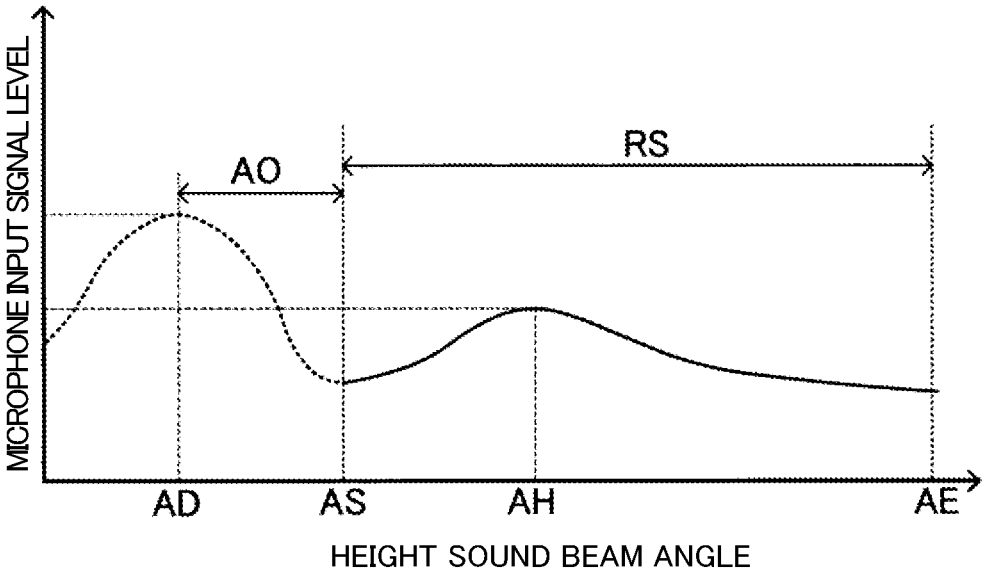
FIG. 10 is a view illustrating an offset angle.

The speaker array apparatus 1 according to the second preferred embodiment obtains the direct sound output angle AD and, sets, as the start angle AS, an angle obtained by adding the direct sound output angle AD to a predetermined offset angle AO (see FIG. 8 and FIG. 9). This does not cause the speaker array apparatus 1 to erroneously set the direct sound output angle AD as the output angle AH of the height sound beam SH.

The Offset Angle AO

The offset angle AO will be described in detail with reference to FIG. 9. FIG. 9 is a view showing the directivity of the sound beam that is output from the height speaker array 30. The horizontal axis indicates an angle when the horizontal direction is set to zero degrees from the side view of the apparatus body LA, and the vertical axis indicates a sound pressure level. In the following description, as shown in FIG. 9, a peak that has the highest sound pressure level shows a main lobe, and a plurality of peaks that are positioned around the main lobe and have a level lower than the level of the main lobe each show a side lobe.

The system control portion 10, as the offset angle AO, sets a value smaller than an angle difference A3 between an angle A1 corresponding to the main lobe and an angle A2 corresponding to the side lobe adjacent to the main lobe. In other words, the system control portion 10 does not set the offset angle AO to the angle difference A3. In the example shown in FIG. 9, the offset angle AO is set to correspond to a point at which the sound pressure level of the main lobe drops to the sound pressure level of the peak of the side lobe. Accordingly, when the test sound beam starts to be output at the start angle AS, the side lobe of the test sound beam does not turn to the listening position, which does not form a peak as a direct sound. Therefore, the speaker array apparatus 1, by setting the offset angle AO in this way, can prevent the peak from being erroneously detected.

While some preferred embodiments have been described based on the preferred embodiments, the present invention is not limited to the above described preferred embodiments and can be modified in various ways. For example, while, in the above described preferred embodiments, the speaker array apparatus 1 includes the speaker array 20 configured to produce a horizontally directed sound field and the height speaker array 30 configured to produce a height (vertical) directed sound field in the apparatus body 1A, the present invention is not limited to such a mode. For example, the speaker array apparatus 1 can be configured to have only the height speaker array 30.

Alternatively, the speaker array may have a configuration in which the sound beam can be swept (turned) in the vertical direction, and, for example, a plurality of speakers configuring the speaker array may be installed in a row in the vertical direction. Therefore, the speaker array 20 in the above described preferred embodiments may also be functioned as a speaker array that outputs the sound beam of the height channel.

Figure 11:
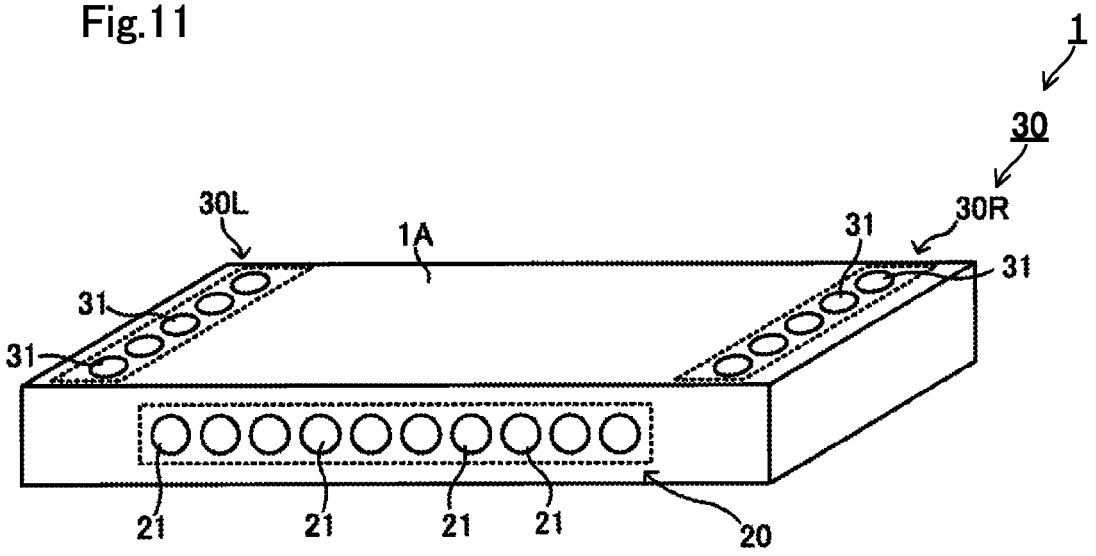
FIG. 11 is a view illustrating a modification of the speaker array apparatus according to the first preferred embodiment.

In addition, while, in the above described preferred embodiments, the height speaker array 30, as shown in FIG. 1, is configured so that the plurality of height speakers 31 are arranged in a line form in the vertical direction, in the front face extending vertically in the apparatus body 1A, the present invention is not limited to such a mode. For example, the height speaker array 30L and the height speaker array 30R, as shown in FIG. 11, may be configured so that the plurality of height speakers 31 are arranged in a line form from the front side to the back side, in both right and left ends of the top face of the apparatus body 1A. In such a case, the speaker array apparatus 1 can control the directivity in the vertical direction by controlling the delay of the sounding timing of each of the height speakers 31 arranged extending from the front side to the back side.

In addition, while the speaker array apparatus 1 according to the above described preferred embodiments has a multichannel configuration including the seven channels: Lch, Rch, SLch, SRch, Cch, HLch, and HRch, the prevent invention is not limited to this mode, and, as long as the configuration is capable of outputting the sound beam that reproduces the height channels (HLch and HRch), various configurations can be employed. For example, the multichannel (Lch, Rch, SLch, SRch, and Cch) configuration that produces a horizontal directed sound field can be variously changed to stereo channel (Lch and Rch).

Moreover, while the speaker array apparatus 1, based on the listening distance D, sets both the height sweep start angle AS and the sweep range RS, a mode in which either the start angle AS or the end angle AE is set may be employed.

Then, the sweep range according to the preferred embodiments means a range in which the output angle of the sound beam according to the height channel is set, that is, the sweep range of a test sound beam, and a range in which the data of a sound that has been picked up by the microphone 40 is analyzed. Accordingly, a configuration in which the sweep range of a test sound beam and the analysis range of the picked-up sound data are made different from each other can also be employed. For example, in a sweep range, relating to the sound data of a sound picked up by performing the sweep of the test sound beam, a configuration in which the analysis range with respect to the sound data is limited within an appropriate range can be employed based on positional information (the listening distance D, for example). Specifically, the speaker array apparatus 1, in an analysis angle range with reference to the horizontal direction, sets an analysis start angle to be larger as the listening distance D is smaller. It should be noted that the analysis start angle is a minimum angle within the analysis angle range. Accordingly the analysis angle range doesn't include the direct sound output angle AD. Moreover the speaker array apparatus 1 sets the analysis angle range to be smaller as the listening distance D is smaller. Accordingly the speaker array apparatus 1 can effectively detect the peak of the signal level of the reflected sound of the test sound beam.

Moreover, while the speaker array apparatus 1 according to the first preferred embodiment, as the listening distance D, uses a distance approximating the horizontal distance between the speaker array 20 and the microphone 40, the present invention is not limited to such a mode. More specifically, the listening distance may be a distance including the difference in height between the speaker array 20 and the microphone 40 and can also employ the shortest distance between the speaker array 20 and the height speaker array 30.

Furthermore, while, in the above described preferred embodiments, before the output angle AH of the height sound beam SH is set, the sweep direction of a test sound beam is a direction of sweeping (turning) from a zero-degree side to a vertically upward side in the case in which the horizontal direction is set to zero degrees, the preferred embodiments are not limited to such a mode and the mode can be changed to a configuration in which the sweep direction is from the vertically upward side toward the horizontal direction. In a case in which the sweep direction of the test sound beam in the above described preferred embodiments is changed, the end angle AE is set based on the listening distance D in the case of the first preferred embodiment.

Similarly, in the case of the second preferred embodiment, the end angle AE may be set based on the direct sound output angle AD and the offset angle AO.

Additionally, while, in the above described preferred embodiments, the listening distance D or the direct sound output angle AD is read from the storage portion 3 to be used, the preferred embodiments are not limited to such a mode. Before the output angle of the height sound beam SH in the height speaker array 30 is set, the listening distance D or the direct sound output angle AD can also be measured by using the test sound beams from the height speaker array 30.

Moreover, the listening distance D or the direct sound output angle AD may also be set by using the information that has been input from the operating portion 4. The information to be input from the operating portion 4 includes the horizontal distance (that is, the listening distance D) from the center of the apparatus body 1A to the microphone 40 and a distance (difference in height) in the vertical direction between the apparatus body 1A and the microphone 40, and the direct sound output angle AD can be calculated by using a difference between the listening distance D and the height. It should be noted that the distance to be input from the operating portion 4 is required to be measured by a listener.

Finally, the above described preferred embodiments are to be considered in all respects as illustrative and not restrictive. The scope of the present invention is defined by the following claims, not by the foregoing preferred embodiments. Further, the scope of the present invention is intended to include the scopes of the claims and all possible changes and modifications within the senses and scopes of equivalents.

What is claimed is:

1. A speaker array apparatus comprising:

a speaker array including a plurality of speakers arranged in a matrix form or in a line form;

a beam forming portion configured to distribute a sound signal to each of the speakers, control an output timing of a sound that is output from each of the speakers, and cause the speaker array to output a sound beam;

a beam control portion configured to output to the beam forming portion a test signal and an output angle of a test sound beam based on the test signal and turn the test sound beam by changing the output angle, in a predetermined angle range in a vertical direction with respect to a horizontal direction;

a microphone arranged at a listening position;

a distance obtaining portion configured to obtain a distance between the speaker array and the microphone; and a storage portion configured to store pickup sound data in association with the output angle, the pickup sound data being generated by a sound picked up by the microphone, wherein:

the beam control portion sets the output angle corresponding to a peak of a signal level in the pickup sound data stored in the storage portion as an output angle of a sound beam of a height channel; and the beam control portion sets a minimum output angle of the angle range to be larger as the distance obtained by the distance obtaining portion is smaller.

2. The speaker array apparatus according to claim 1, wherein the beam control portion sets the angle range to be smaller as the distance obtained by the distance obtaining portion is smaller.

3. The speaker array apparatus according to claim 1, wherein:

the beam control portion, in a second angle range in the vertical direction with respect to the horizontal direction, turns a second sound beam;

the beam control portion specifies the output angle corresponding to the peak of the signal level in the pickup sound data corresponding to the second sound beam as an output angle of a direct sound; and the beam control portion sets the minimum output angle to be larger than the output angle of the direct sound.

4. The speaker array apparatus according to claim 3, wherein the beam control portion sets the minimum output angle by adding a predetermined offset angle to the output angle of the direct sound.

5. The speaker array apparatus according to claim 4, wherein the offset angle is smaller than an angle difference between an angle of a main lobe in directional characteristics of the sound beam and an angle of a side lobe adjacent to the main lobe.

6. The speaker array apparatus according to claim 3, further comprising a second speaker array including a plurality of speakers arranged in a matrix form or in a line form, wherein the second sound beam is output from the second speaker array.

7. The speaker array apparatus according to claim 1, wherein the beam control portion, in a case in which the pickup sound data includes a plurality of peaks of the signal level, sets the output angle corresponding to a maximum peak as the output angle of the sound beam of the height channel.

8. The speaker array apparatus according to claim 1, wherein:

the beam control portion, in a second angle range in the vertical direction with respect to the horizontal direction, turns a second sound beam; and the distance obtaining portion, in the output angle corresponding to the peak of the signal level in the pickup sound data corresponding to the second sound beam, obtains the distance based on a difference between an output timing of the second sound beam and a pickup sound timing of the microphone.

9. The speaker array apparatus according to claim 1, further comprising an operating portion configured to receive an input operation such that the distance is input, wherein the distance obtaining portion obtains the distance from the operating portion.

10. The speaker array apparatus according to claim 1, further comprising a housing including a surface configured to face the listening position, wherein the plurality of speakers are arranged on the surface.

11. The speaker array apparatus according to claim 1, further comprising a housing including a top surface that has a normal direction in the vertical direction, wherein the plurality of speakers are arranged on the top surface.

12. A method for setting a speaker array apparatus comprising a speaker array including a plurality of speakers arranged in a matrix form or in a line form, the method comprising the acts of:

distributing a sound signal to each of the speakers, controlling an output timing of a sound that is output from each of the speakers, and causing the speaker array to output a sound beam;

changing an output angle of a test sound beam based on a test signal and turning the test sound beam in a predetermined angle range in a vertical direction with respect to a horizontal direction;

picking up a sound of the test sound beam by a microphone arranged at a listening position;

obtaining a distance between the speaker array and the listening position;

storing pickup sound data in association with the output angle, the pickup sound data being generated in the picking sound act; and setting the output angle corresponding to a peak of a signal level in stored pickup sound data as an output angle of a sound beam of a height channel, wherein, in the turning sound beam act, a minimum output angle of the angle range is set to be larger as the distance obtained in the obtaining distance act is smaller.

13. A speaker array apparatus comprising:

a speaker array including a plurality of speakers arranged in a matrix form or in a line form;

a beam forming portion configured to distribute a sound signal to each of the speakers, control an output timing of a sound that is output from each of the speakers, and cause the speaker array to output a sound beam;

a beam control portion configured to output to the beam forming portion a test signal and an output angle of a test sound beam based on the test signal and turn the test sound beam by changing the output angle, in a predetermined angle range with respect to a horizontal direction;

a microphone arranged at a listening position;

a distance obtaining portion configured to obtain a distance between the speaker array and the microphone; and a storage portion configured to store picked-up sound data in association with the output angle, the picked-up sound data being generated by a sound picked up by the microphone, wherein:

the speaker array apparatus further comprise a measured data analysis portion configured to detect, in a predetermined analysis angle range in a vertical direction, an output angle corresponding to a peak of a signal level in the pickup sound stored in the storage portion;

the beam control portion sets an output angle detected by the measured data analysis portion as an output angle of a sound beam of a height channel; and the measured data analysis portion sets a minimum angle of the analysis angle range to be larger as the distance obtained by the distance obtaining portion is smaller.

14. The speaker array apparatus according to claim 13, wherein the measured data analysis portion sets the analysis angle range to be smaller as the distance obtained by the distance obtaining portion is smaller.

15. A speaker array apparatus comprising:

a speaker array including a plurality of speakers arranged in a matrix form or in a line form;

a microphone arranged at a listening position; and at least one processor executing stored programmable instructions to:

distribute a sound signal to each of the speakers, control an output timing of a sound that is output from each of the speakers, cause the speaker array to output a sound beam, output a test signal and an output angle of a test sound beam based on the test signal and turn the test sound beam by changing the output angle, in a predetermined angle range in a vertical direction with respect to a horizontal direction, obtain a distance between the speaker array and the microphone, store pickup sound data in association with the output angle, the pickup sound data being generated by a sound picked up by the microphone, set the output angle corresponding to a peak of a signal level in the pickup sound data as an output angle of a sound beam of a height channel, and set a minimum output angle of the angle range to be larger as the distance between the speaker array and the microphone is smaller.

16. A speaker array apparatus comprising:

a speaker array including a plurality of speakers arranged in a matrix form or in a line form;

a microphone arranged at a listening position; and at least one processor executing stored programmable instructions to:

distribute a sound signal to each of the speakers, control an output timing of a sound that is output from each of the speakers, cause the speaker array to output a sound beam, output a test signal and an output angle of a test sound beam based on the test signal and turn the test sound beam by changing the output angle, in a predetermined angle range with respect to a horizontal direction, obtain a distance between the speaker array and the microphone, store picked-up sound data in association with the output angle, the picked-up sound data being generated by a sound picked up by the microphone, detect, in a predetermined analysis angle range in a vertical direction, an output angle corresponding to a peak of a signal level in the pickup sound stored in the storage portion, set the detected output angle as an output angle of a sound beam of a height channel, and set a minimum angle of the analysis angle range to be larger as the distance between the speaker array and the microphone is smaller.

* * * * *